US005907913A

United States Patent [19]

Kock

[11] Patent Number: 5,907,913

[45] Date of Patent: Jun. 1, 1999

[54] DEVICE FOR REDUCING KNEE STRESS WHEN CLIMBING AND DESCENDING STAIRS AND METHOD OF USE

[76] Inventor: Nancy E. Kock, 577 Abilene Trail, Wyoming, Ohio 45215

[21] Appl. No.: 09/018,764

[22] Filed: Feb. 5, 1998

[51] Int. Cl.[6] ..... A61H 1/00; A63B 23/04

[52] U.S. Cl. ..... 36/132; 36/136; 36/110; 36/146; 36/140; 601/33; 482/52

[58] Field of Search ..... 602/10; 482/52, 482/79, 105, 907; 128/893; 601/33; 36/81, 132, 136, 7.1 R, 7.5, 7.6, 110, 140

[56] References Cited

U.S. PATENT DOCUMENTS

| | | | |
|---|---|---|---|
| 843,199 | 2/1907 | Doyle | 36/7.3 |
| 1,516,395 | 11/1924 | Miceli | 36/7.6 |
| 3,198,192 | 8/1965 | O'Brien | 602/10 |
| 3,613,674 | 10/1971 | Volz | 602/10 |
| 3,751,833 | 8/1973 | Humphrey | 36/81 |
| 4,088,336 | 5/1978 | Chapel | 280/11 |
| 4,414,759 | 11/1983 | Morgan et al. | 36/110 |
| 4,546,557 | 10/1985 | Barouk et al. | 36/110 |
| 4,567,678 | 2/1986 | Morgan et al. | 36/110 |
| 4,726,127 | 2/1988 | Barouk | 36/110 |
| 4,821,432 | 4/1989 | Reiber | 36/110 |
| 5,177,883 | 1/1993 | Darby | 36/132 |

OTHER PUBLICATIONS

Richard's Manufacturing Company Catalog, May 1966, p. 40.

*Primary Examiner*—Paul T. Sewell
*Assistant Examiner*—Anthony Stashick
*Attorney, Agent, or Firm*—Ronald W. Kock

[57] ABSTRACT

A device and method of use for reducing knee bend, and therefore knee stress, when climbing and descending stairs. The method includes a first step of removably securing to a first foot of a user a device having an elevation of approximately half a step rise. A second method step includes lifting a second foot of the user onto a first stair step while applying full body weight to the first knee. A third method step includes lifting the first foot and the device while applying full body weight to a second knee in order to place the first foot and the device on the first step adjacent to the second foot. Lifting the second foot and lifting the first foot and the device are achieved while the first and second knees are bent no more than an angle necessary to climb approximately half a step rise. The sequential foot lifting is repeated until the user has climbed the stairs. The device includes a foot securing portion for removably attaching it to only one of a user's feet. The device also includes an elevating portion connected to the foot securing portion. Together both portions have an elevation approximately half a step rise.

7 Claims, 2 Drawing Sheets

DEVICE FOR REDUCING KNEE STRESS WHEN CLIMBING AND DESCENDING STAIRS AND METHOD OF USE

FIELD OF THE INVENTION

The present invention relates to mechanical devices used by arthritic patients or others wishing to minimize joint stresses which aggravate their pain or joint injuries, and more particularly to such devices intended to reduce knee stress so that stairs may be climbed or descended.

BACKGROUND OF THE INVENTION

Climbing stairs is known to place stresses on the knee joints which aggravate knee injuries or arthritic knee deterioration, usually resulting in immediate or delayed pain. People with such knee conditions are advised not to climb or descend stairs. Since most homes and buildings have more than one floor level, stairs are a common feature of inhabited buildings. Nursing homes, on the other hand, are often designed to have only a single floor level to eliminate stairs for their senior residents who are of the age most likely to have knee joint injuries and/or arthritis.

The alternative to climbing or descending stairs in a home or building in which one resides or works is to ride an elevator, escalator, chair lift, or scoot on one's bottom so as to minimize the knee bending while supporting body weight, which is required for climbing or descending stairs. It is known that the greater the angle the knee joint bends when body weight is supported, the greater the stress on the knee joint. Since climbing and descending stairs applies full body weight to one knee joint at a time, such activity places even more stress on the knees than just standing and bending both knees simultaneously. Typical home and building staircases are designed with a rise between steps of 7 to 9 inches and an overall angle of incline ranging from 35° to 45°. When a person climbs such stairs one at a time, the average adult knee joint bends from 50° to 70° as measured from an axis through an ankle joint and corresponding knee joint.

Providing stairs with a gentler angle of incline and/or reduced elevation between steps would reduce the angle of knee bend and therefore the stress placed on knee joints. However, such reductions would increase the space needed for stairs and make stair climbing inconvenient for the majority of people who have no knee joint problems. Furthermore, it would be nearly impossible to convert all the existing staircases to have significantly lower angles of incline or a significantly greater number of steps.

What has been missing is a wearable device which reduces the angle of knee bend when climbing or descending stairs to an angle such that the knee stress is reduced to an acceptable level that minimizes knee joint strain or pain.

SUMMARY OF THE INVENTION

In one aspect of the present invention, a method of reducing knee bend, and therefore knee stress, when climbing stairs comprises a first step of removably securing to a first foot of a user a device having an elevation of approximately half a step rise. A step rise is defined as the elevation difference between two adjacent steps of the staircase, and it is presumed constant from step to step. The first foot is connected to a first knee via a first lower leg. A second method step includes lifting a second foot of the user onto a first step while applying full body weight to the first knee. The second foot is connected to a second knee via a second lower leg. A third method step includes lifting the first foot and the device while applying full body weight to the second knee in order to place the first foot and the device on the first step adjacent to the second foot. Lifting the second foot and lifting the first foot and the device are achieved while the first and second knees are bent no more than an angle necessary to climb approximately half a step rise. The method further includes the steps of repeating the sequence of foot lifting until the user has climbed the stairs and then includes removing the device from the first foot so that the device is available for the user to descend the stairs at a later time.

Preferably, a foot securing portion of the device has an upper surface spaced approximately 4 inches from a bottom surface of an elevating portion of the device.

In another aspect of the present invention, a device for reducing knee bend, and therefore knee stress, when climbing stairs comprises a foot securing portion for removably attaching the device to only one of a user's feet. The device also includes an elevating portion connected to the foot securing portion. The elevating portion and the foot securing portion together have an elevation of approximately half a step rise. When the user climbs the stairs, and while full body weight is applied to one bent knee, neither of the user's knees is bent to more than an angle necessary to climb half a step rise, so that the user may climb stairs while minimizing knee stress associated with full step rise climbing.

Preferably, the foot securing portion and the elevating portion are constructed as one piece. Also, the foot elevating portion is preferably made of a rigid polymer foam, thereby providing a light-weight device with sufficient strength and rigidity.

BRIEF DESCRIPTION OF THE DRAWINGS

While the specification concludes with claims which particularly point out and distinctly claim the present invention, it is believed that the present invention will be better understood from the following description of preferred embodiments, taken in conjunction with the accompanying drawings, in which like reference numerals identify identical elements and wherein:

DETAILED DESCRIPTION OF THE INVENTION

Figure 1:
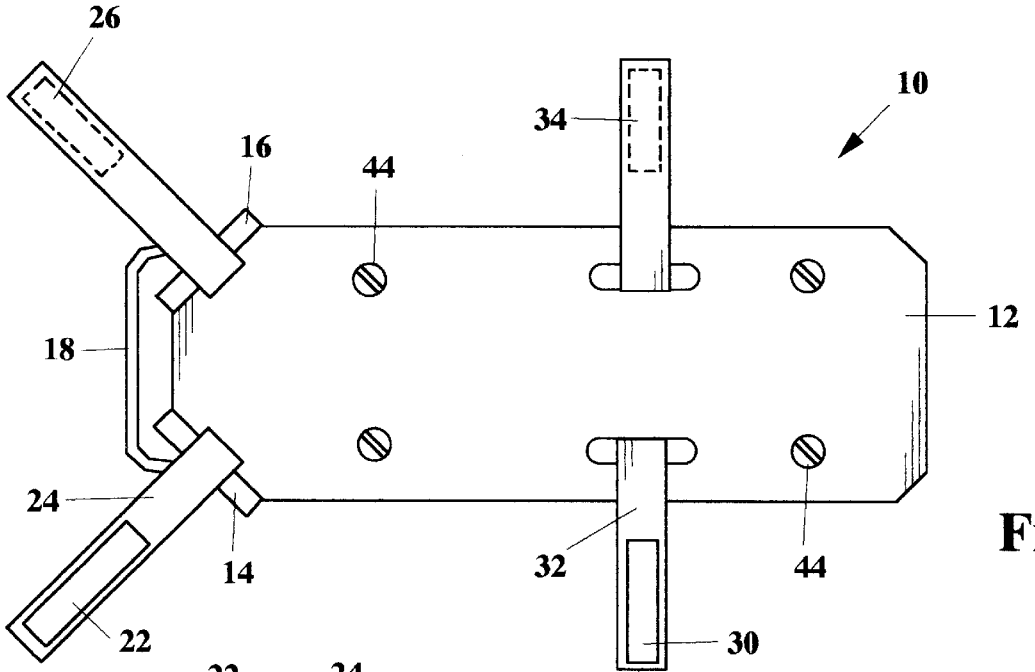
FIG. 1 is a top plan view of a preferred embodiment of the device for reducing knee stress of the present invention, disclosing a footplate having straps for securing a user's foot or shoe thereto.
Figure 2:
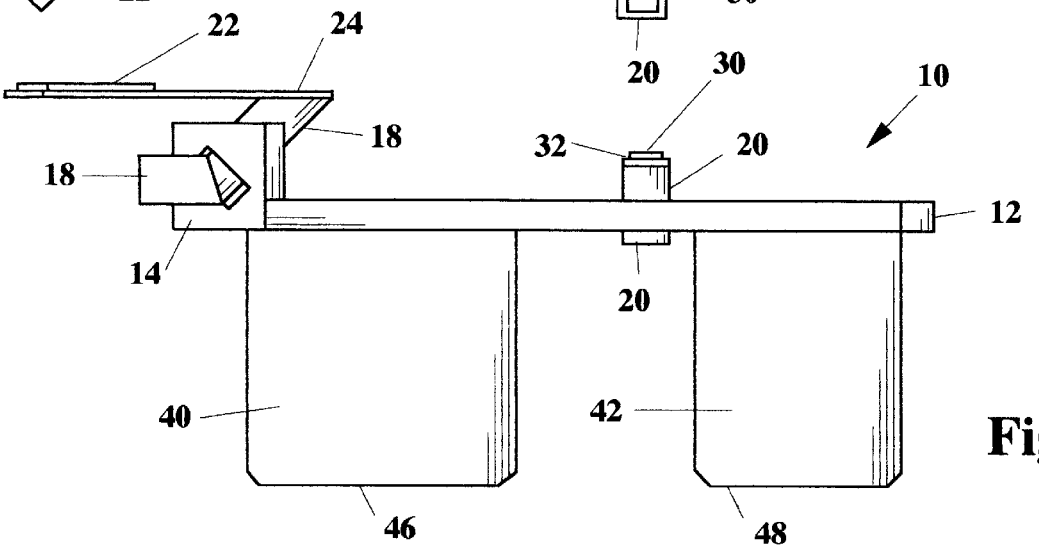
FIG. 2 is a front elevation view thereof, showing the footplate having two blocks underneath, which provide a footplate elevation approximately half an average step rise.

Referring now to the drawings, and more particularly to FIGS. 1 and 2, there is shown a preferred embodiment of the present invention, which provides a device for reducing knee bend, and therefore knee stress, when climbing or descending stairs and which is generally indicated as 10. Device 10 has a securing portion for removably securing a user's foot or shoe thereto. The securing portion of device 10 is shown as a footplate 12 having upright rear edges 14 and 16 for supporting the heal of a user's foot and an ankle strap 18 and a toe strap 20 extending outwardly from near the perimeter of footplate 12.

Straps 18 and 20 preferably have quick-connect means, such as hook and loop fasteners which engage by mere contact when overlapped to prevent one half of a strap sliding relative to the other half along their engagement surfaces, but which are easily separated by lifting or peeling one half of the strap away from the contact surface of the other half. Strap 18 preferably has loop surface 22 on an upper side 24 and a hook surface 26 on a lower side. Similarly, strap 20 preferably has a loop surface 30 on an upper side 32 and a hook surface 34 on a lower side. Straps 18 and 20 are each preferably continuous pieces of cloth, leather, or flexible polymer strip threaded through slots in footplate 12, and loop and hook surfaces are preferably sewn or adhesively bonded to the straps. Alternatively, straps 18 and 20 are four separate pieces, each connected to footplate 12, or a single strap located approximately midway between straps 18 and 20. Also, the present invention may include a socket into which a foot is inserted to enable the foot to manipulate the footplate without the need for the user to overlap and engage strap ends.

The key to the usefulness of the device of the present invention is the addition of an elevating portion to the underside of footplate 12, which elevates the top surface of footplate 12 to approximately half the rise of a conventional step in a flight of stairs, which is about 4 inches. The elevating portion is a rear block 40 and a front block 42 screwed to footplate 12 by countersunk screws 44. Blocks 40 and 42 have bottom surfaces 46 and 48, respectively, which are preferably slip-resistant when placed against steps having slick surfaces. Such slip resistance may be obtained by providing a rubber tread to surfaces 46 and 48, for example. Blocks 40 and 42 are preferably placed along 3, the underside of footplate 12 to support the entire length of the users foot. Blocks 40 and 42, along with footplate 12 are preferably as light weight as possible, while being substantially rigid and having sufficient strength to support the user's weight without substantial deformation. Substantial deformation could possibly cause instability in the use of device 10 and should be minimized. Preferably, footplate 12 is made of wood, rigid plastic, or aluminum, ranging from 0.2 to 0.4 inches in thickness; and blocks 40 and 42 are made of rigid polymer foam, plastic, wood, or aluminum, which may be solid as shown, tubular, or otherwise pocketed to reduce weight without substantially compromising rigidity and strength. Although the elevating portion is shown as two pieces separated for access to threading toe strap 20 through slots in footplate 12, a single long block could be used to elevate footplate 12; or footplate 12 could be constructed as a single piece having an elevating portion molded or fabricated as part of footplate 12. Most preferably, foot securing and elevating portions are made as a single piece of injection molded plastic; and even more preferably, the single piece is made of a light-weight rigid foam. However, successful prototype devices have been made of a ⅜ inch thick sandcast aluminum footplate and 4 inch cubes of cedar wood.

Figure 3:
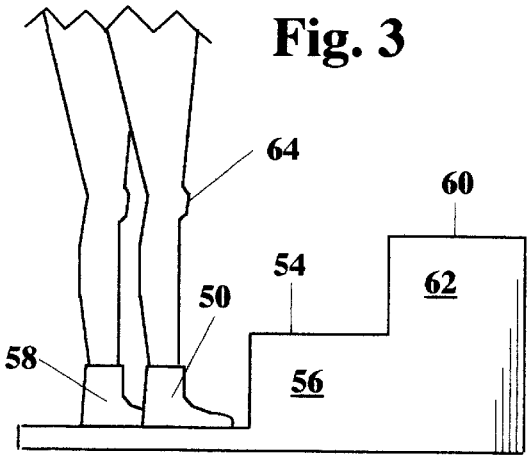
Fig. 3 PRIOR ART
FIG. 3 is a front elevation view of the prior art, showing a person about to climb stairs without the device of the present invention.
Figure 4:
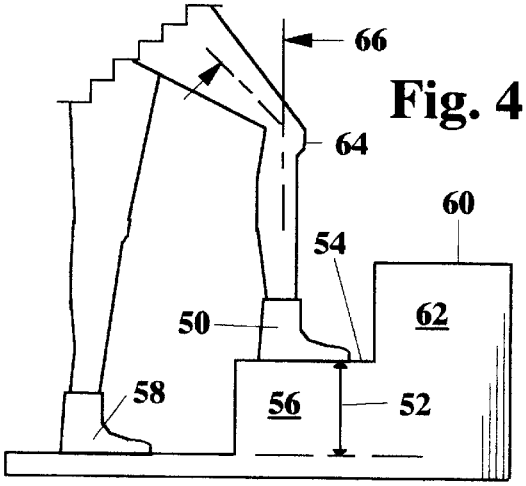
Fig. 4 PRIOR ART
FIG. 4 is a front elevation view of the prior art, showing a person climbing a first step without the device of the present invention, and indicating a large bend angle of the knee.

FIGS. 3 and 4 illustrate the prior art method of climbing stairs. That is, a user lifts a first foot 50 by a full step rise 52 onto a top surface 54 of a first step 56, and then lifts a second foot 58 onto a top surface 60 of a second step 62 while first foot 50 remains on first step 56. In the process of climbing, the user supports his/her entire body weight on bent knee 64, which is connected to first foot 50, while lifting second foot 58 onto second step 62. Bent knee 64 has a bend angle 66 of approximately 50° to 700° when full body weight is supported by the knee 64. The exact angle depends upon the step rise and the length of the user's legs. Since it is well known that the stress applied to bent knee 64 increases as angle 66 increases, people having injured, arthritic, and otherwise painful kneejoints need to reduce the bend angle and therefore the stress applied to their knees. Avoiding stair climbing and descending is frequently recommended to such people by their doctors. However, most homes and other buildings are designed with stairs.

Figure 5:
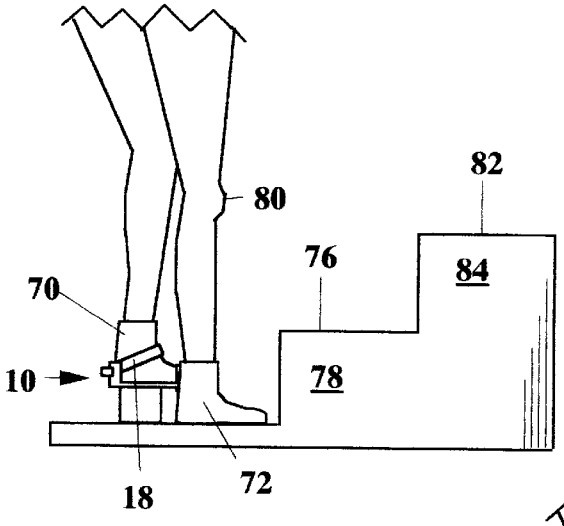
FIG. 5 is a front elevation view of a method of use of the device for reducing knee stress of the present invention, disclosing a person ready to climb stairs and having an elevated footplate device strapped to a first foot.
Figure 6:
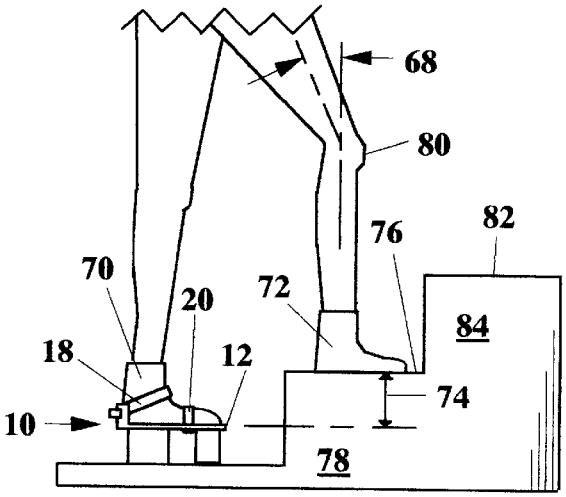
FIG. 6 is a front elevation view thereof, showing the person climbing the first step by lifting a second foot onto the top of the first step while the first foot rests on the elevated footplate, and indicating a small bend angle of the knee.
Figure 7:
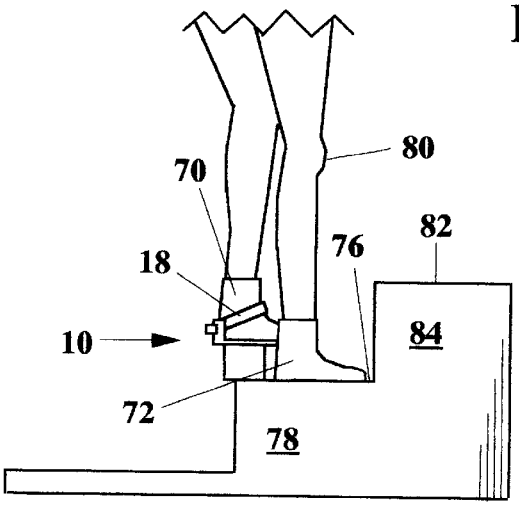
FIG. 7 is a front elevation view thereof, showing the person lifting the first foot with device attached onto the top of the first step adjacent the second foot.

Device 10 permits a person to climb stairs with minimum knee stress because the knee bend angle is substantially reduced. FIGS. 5–7 show the preferred use of device 10 when climbing stairs. The user of device 10 first straps footplate 12 to his/her first foot 70 or to a shoe on first foot 70 by means of straps 18 and 20. Preferably, the hook surface end of each strap is first placed over the foot with the hook surface facing upward. Then, the loop surface end of each strap is placed over the hook surface end such that the loop surface faces downward. The straps are pulled snuggly around the foot before allowing the loop surface to contact the hook surface. Finally, the loop surface is pressed against the hook surface to engage the two interlocking surfaces. Alternatively, the first foot or shoe is slipped into a snug socket atop a footplate.

Once footplate 12 is secured to the user's first foot 70, the user is ready to climb the first step. While standing with first foot 70 elevated on device 10, the user lifts a second foot 72 onto a top surface 76 of a first step 78. As shown in FIG. 6, a half step rise 74 exists between first foot 70 and surface 76. This results in a bend angle 68 of approximately 30° to 50° at knee 80, which is connected to second foot 72. While fully supporting body weight on bent knee 80, the user lifts first foot 70 and device 10 onto top surface 76 of first step 78. In this position, the user is ready to repeat the process by lifting second foot 72 onto a top surface 82 of a second step 84. As can be seen, the speed with which one can climb a staircase is slowed by the use of device 10, but the angle of knee bend is also reduced by approximately 20° compared to conventional stair climbing, thereby allowing persons with knee pain, injury, or arthritis to climb stairs more comfortably. When descending stairs, a similar method is used with device 10, whereby each foot is placed on the same step before successive steps are descended.

Device 10 is most useful for people having problems with both knees. If only one knee is injured, a person could follow the method illustrated for the present invention in FIGS. 5–7 but without device 10 attached to one foot. In this situation, the injured knee would preferably be connected to the first foot.

While particular embodiments of the present invention have been illustrated and described, it will be obvious to those skilled in the art that various changes and modifications may be made without departing from the spirit and scope of the invention, and it is intended to cover in the appended claims all such modifications that are within the scope of the invention.

What is claimed is:

1. A method of reducing knee bend, and therefore knee stress, when climbing a step, said method comprising the steps of:

a) removably securing to a bottom surface of a first foot of a user a device having an elevation of approximately half a step rise, the user having body weight, a first knee, a second foot, and a second knee;

b) lifting said second foot of the user onto a step while applying said body weight onto said first foot through said first knee while said first knee is bent substantially no more than an angle necessary to climb approximately half a step rise; and c) lifting said first foot and said device secured thereto onto said step while applying said body weight to said second foot through said second knee while said second knee is bent substantially no more than an angle necessary to climb approximately half a step rise.

2. The method of claim 1 further comprising the step of removing said device from said first foot after said step has been climbed.

3. The method of claim 1 wherein said device comprises a foot securing portion and a foot elevating portion connected to said foot securing portion, said foot securing portion having an upper surface spaced approximately 4 inches from a bottom surface of said foot elevating portion.

4. The method of claim 3 wherein said foot securing portion and said foot elevating portion are constructed as one piece.

5. The method of claim 3 wherein said foot elevating portion is made of rigid polymer foam.

6. A method of reducing knee bend, and therefore knee stress, when climbing a step, said method comprising the steps of:

a) removably securing to a bottom surface of a first foot of a user a device having an elevation of approximately half a step rise, the user having body weight, a first knee, a second foot, and a second knee;

b) lifting said second foot of the user onto a step while applying said body weight onto said first foot through said first knee while said first knee is bent at an angle no more than about 50°; and c) lifting said first foot and said device secured thereto onto said step while applying said body weight to said second foot through said second knee while said second knee is bent in an angle no more than about 50°, said angles being substantially less than would be required to climb said step without said device secured to said first foot.

7. The method of claim 6 further comprising the step of removing said device from said first foot after said step has been climbed.

* * * * *